US005982849A

United States Patent [19]

Bischof

[11] Patent Number: 5,982,849

[45] Date of Patent: Nov. 9, 1999

[54] HIGH TEMPERATURE WARNING DEVICE FOR AN X-RAY GENERATOR

[75] Inventor: Norbert Bischof, Roethenbach, Germany

[73] Assignee: Siemens Aktiengesellschaft, Munich, Germany

[21] Appl. No.: 09/032,483

[22] Filed: Feb. 27, 1998

[30] Foreign Application Priority Data

Feb. 27, 1997 [DE] Germany ..... 197 07 996

[51] Int. Cl.[6] ..... H01J 35/10

[52] U.S. Cl. ..... 378/130; 378/127; 378/141

[58] Field of Search ..... 378/130, 127, 378/141, 199, 200, 201, 202, 117, 118; 340/598; 374/167

[56] References Cited

U.S. PATENT DOCUMENTS

| | | | |
|---|---|---|---|
| 4,571,095 | 2/1986 | Stoffels | 374/167 |
| 4,862,489 | 8/1989 | Appelt | 378/117 |
| 4,901,060 | 2/1990 | Liu | 340/598 |
| 5,497,410 | 3/1996 | Behling . | |
| 5,684,855 | 11/1997 | Aradate et al. | 378/4 |

FOREIGN PATENT DOCUMENTS

| | | |
|---|---|---|
| PS 973690 | 7/1949 | Germany . |
| OS 3927240 | 8/1973 | Germany . |

*Primary Examiner*—David P. Porta
*Assistant Examiner*—Michael J. Schwartz
*Attorney, Agent, or Firm*—Hill & Simpson

[57] ABSTRACT

A high temperature warning device for an x-ray source has a housing that can be attached to the exterior of the housing wall of an x-ray generator housing. The device has an integrated signaling alarm which is activated depending on the detection result of at least one temperature sensor communicating with the x-ray generator housing.

15 Claims, 1 Drawing Sheet

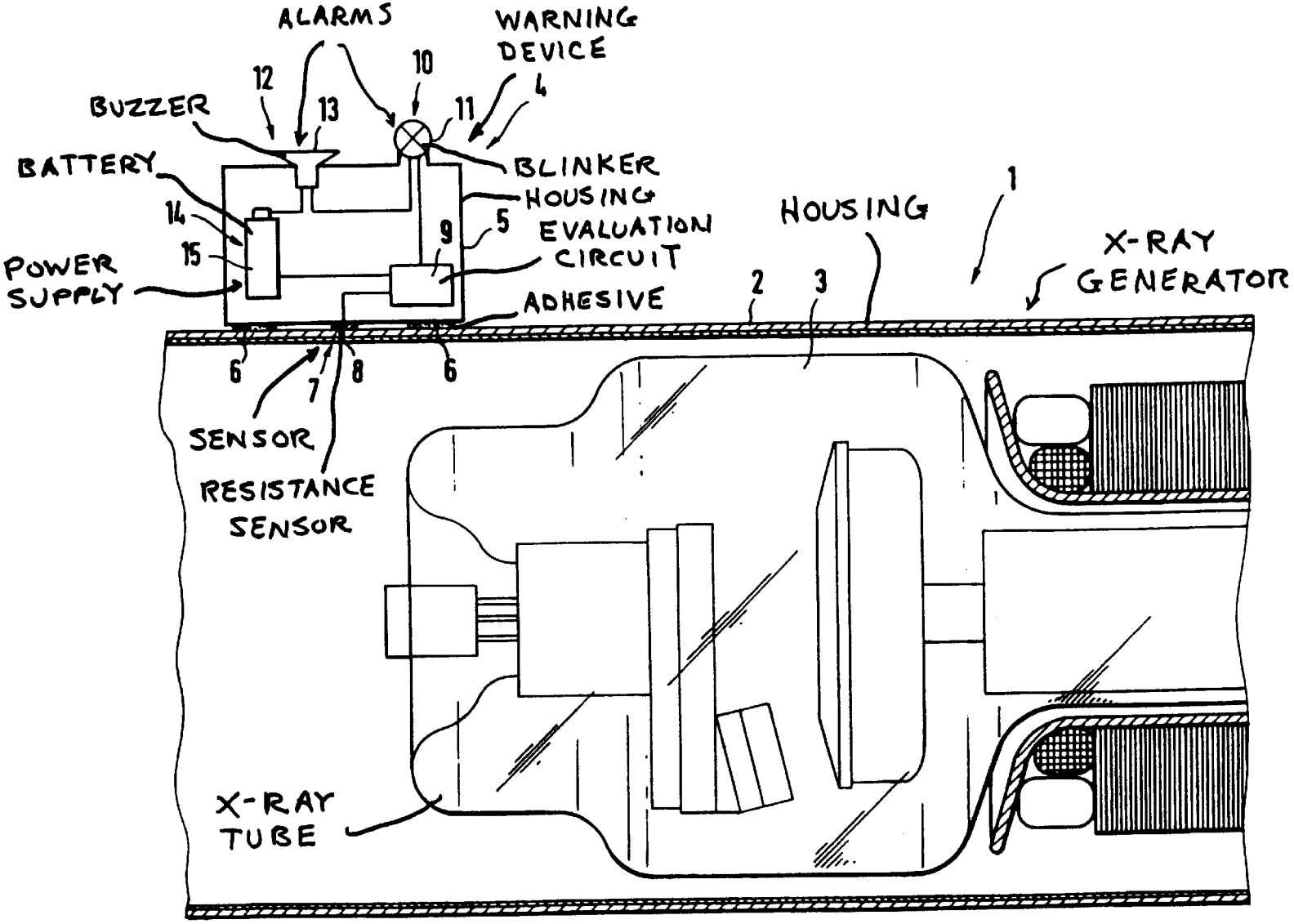
X-RAY GENERATOR
1
HOUSING
3
2
WARNING DEVICE
4
BLINKER
HOUSING
5
EVALUATION CIRCUIT
ADHESIVE
11
10
9
6
ALARMS
13
8
7
12
6
BUZZER
14
15
BATTERY
POWER SUPPLY
SENSOR
RESISTANCE SENSOR
X-RAY TUBE

HIGH TEMPERATURE WARNING DEVICE FOR AN X-RAY GENERATOR

BACKGROUND OF THE INVENTION

1. Field of the Invention

The present invention is directed to a warning device for an x-ray source, and in particular to a device which warns when an excessively elevated temperature of the coolant contained in the radiation source housing occurs.

2. Description of the Prior Art

An x-ray generator (also referred to as an x-ray radiator) normally includes X-ray tube enclosed in a housing filled with a coolant, e.g. oil, which is circulated with the housing. (in the following discussion, for simplicity, oil is employed as a general representative of a coolant.) In rotating anode tubes a certain potential for danger results from the fact that heat is generated during operation and is stored in the rotating anode, and this heat can only be dissipated by convection, because of the danger that if the tube envelope (which is generally made of glass) breaks, the anode, with a temperature of 1000 K, will come into contact with the oil, and the oil then evaporates on the anode explosively. Under certain conditions such as high oil temperature, the resultant gases can cause the housing of the x-ray generator source to burst. It is possible for the examination subject and the attendants to sustain injury due to hot oil and parts ejected as a result of the explosion. For this reason, an x-ray source is usually provided with a sensor which immediately interrupts the operation of the electron emitter and shuts off the x-ray generator if a certain oil temperature, or if a certain oil pressure, arise within the housing. This results in the disadvantage that a new endangerment of the patient arises in certain examination methods such as a cardiac catheter examination due to the sudden loss of image information.

The danger caused by the sudden loss of image information can be diminished by a timely alarm signal commencing before the shutoff of the system. Such a signal can also be used to limit the operation of the X-ray generator to a lower, safe level. In the prior art this signal is created, for example, by means of an addition in the load computer. The load computer calculates the heat content of the X-radiation source in addition to the heat content of the anode and emits an alarm signal to the attendant upon attainment of a critical heat content with the danger of a shutoff. From this point in time, only an orderly (sequenced) aborting of the examination may still be performed. The loss of image information is thereby to a large extent prevented. Another possibility for creating an alarm signal is to measure the coolant pressure or coolant temperature and to transfer the respective signal to the system, where an alarm signal is then set off. A disadvantage of both methods is that they are very expensive and are consequently used only to a small extent. A further problem is that these warning means are only provided in new x-ray generators, as opposed to a considerable number of currently installed x-ray generator which must operate without such warning means.

From U.S. Pat. No. 5,497,410 it is known to provide an x-ray source with a temperature detector which sets off a switching process when a permitted temperature is surpassed, interrupting the x-ray source's energy supply, for example. The measuring sensor can be located externally of the protective housing.

From German OS 39 27 240 an x-ray source is known with a means for scanning and recording operating parameters of the x-ray source. These means are included in the protective housing of the x-ray source.

From German PS 973 690 optical or acoustical warning devices are known in the context of x-ray diagnosis, for example.

SUMMARY OF THE INVENTION

An object of the invention is to provide a high-temperature warning arrangement for an x-ray generator which is simple in construction and therefore low in its production costs, but which allows the possibility to retrofit currently installed x-ray generators and so as to raise the standard of safety.

This object is achieved in a warning device in accordance with the invention having a housing with an integrated signaling unit which can be activated depending on the detection result of at least one temperature sensor in radiative communication with the x-ray source, the housing being attachable to and detachable from the x-ray generator on its outer housing surface by a securing arrangement.

The inventive warning device is extremely economical to produce, since it is extremely simple in its construction and in the required elements which are used, and for this reason a utilization of the warning device is possible without additional costs becoming too high. Another considerable advantage is that costly installation is not necessary, since the warning arrangement is attachable to the outside of the x-ray source, "old systems" being therefore extremely easy to retrofit and bring up to the required safety standard. The operability of the warning arrangement is guaranteed because the temperature sensor is in radiative communication with the x-ray source, i.e., it communicates directly with the outer shell of the x-ray source, this being in contact with the hot oil and consequently tracking the oil temperature almost without delay, so that corresponding temperature changes are clearly detectible and evalutable. For retrofitting of extant old systems, a securing arrangement for detachably securing to the housing onto the x-ray generator is provided, such as securing clamps or straps or the like. The securing arrangement can alternatively be an adhesive attachment.

Optical or acoustical alarms are excellent signaling means, particularly a warning blinker or a buzzer or the like. A combination of optical and an acoustical signaling is preferably provided, in order to give a number of alarm signals in case of danger.

According to another embodiment of the invention, evaluation circuitry for evaluating the detection result and controlling the signaling means can be provided in order to evaluate the different temperature profiles of different generator types with different powers. An adjustment in the triggering of the alarm can ensue via the evaluation circuitry depending on the generator type.

A resistance sensor has proven suitable as a temperature sensor, with a platinum sensor, especially a Pt 100 Sensor, preferably being used. Alternatively—as the simplest embodiment—the temperature sensor can be a bimetallic strip which acts somewhat like a switching element and closes the switching circuit at a high temperature that leads to a sufficient deformation of the bimetallic strip, whereby the signaling alarm is then activated.

In another embodiment of the invention a recording device is provided for storing the chronological progression of the detection results of the temperature sensor, so that it is possible to track the temperature progression over a longer time-span and to obtain a readout in the framework of a service routine in order to be able to identify operative disturbances and the like. It is possible to operate the respective components of the inventive warning device via an external power supply; however, in a further embodiment of the invention an integrated power supply, especially a battery, is provided. The warning device then has a compact form and no additional external elements.

DESCRIPTION OF THE DRAWING

The single FIGURE is a sectional view of an x-ray generator with a schematically illustrated warning device, constructed in accordance with the principles of the present invention, attached thereto.

DESCRIPTION OF THE PREFERRED EMBODIMENTS

The FIGURE shows an x-ray generator 1 containing an x-ray tube 3 contained in a housing 2. The x-ray generator 1 is depicted only as an exemplary type. The interior space of the housing 2 is filled with oil which serves as a cooling medium and as a thermal transport for transporting the heat given off by the x-ray tube 3 to the housing 2.

The inventive warning device 4 is arranged externally on the housing 2. This warning device 4 has a housing 5 of temperature resistant material. In the example depicted, the housing 5 is secured to the exterior wall of the housing 2 using adhesive. A temperature sensor 7 is integrated into the interior of the housing 5 in the form of a resistance sensor 8; a Pt 100 Sensor preferably is used. In the example shown, the resistance sensor 8 is in direct connection with the wall of the housing. The temperature measured by means of the resistance sensor 8 supplied to an electronic evaluation circuit 9 in the form of corresponding signals, for evaluating the detection result. In the example depicted, a first signaling alarm 10 in the form of a warning blinker 11 and a second signaling alarm 12 in the form of an acoustical buzzer 13 are allocated to the circuit 9. Both are triggered via the circuit 9 whenever the temperature measured by the resistance sensor 8 is sufficiently high and indicates a possible danger. In this case, the attendant receives notice of the fact that a potential overheating can occur with further, longer use.

As the FIGURE further shows, a power supply 14 in the form of a battery 15 is also provided which supplies the respective components of the warning device 4. Instead of the battery 15, of course an accumulator or the like can also be provided.

Although modifications and changes may be suggested by those skilled in the art, it is the intention of the inventor to embody within the patent warranted hereon all changes and modifications as reasonably and properly come within the scope of his contribution to the art.

I claim as my invention:

1. In an x-ray generator having a housing containing an x-ray tube and coolant surrounding said x-ray tube in said housing, the improvement of a warning device which identifies if said coolant reaches an excessive temperature, said warning device comprising:

a warning device housing;

a temperature sensor in said warning device housing;

signaling means contained in said warning housing and connected to said temperature sensor for producing a perceptible warning when said temperature sensor senses a predetermined temperature; and means for releasably attaching said warning device housing to an exterior of said housing of said x-ray generator with said temperature sensor in radiative communication with said housing of said x-ray generator.

2. A warning device as claimed in claim 1 wherein said signaling means comprises means for generating an optical signal as said warning.

3. A warning device as claimed in claim 1 wherein said signaling means comprises means for generating an acoustical signal as said warning.

4. A warning device as claimed in claim 1 wherein said signaling means comprises means for generating an optical signal and an acoustical signal as said warning.

5. A warning device as claimed in claim 1 wherein said temperature sensor produces a detection result, and wherein said signaling means includes electronic means for evaluating said detection result and for controlling emission of said warning.

6. A warning device as claimed in claim 1 wherein said temperature sensor comprises a resistance sensor.

7. A warning device as claimed in claim 6 wherein said resistance sensor comprises a platinum sensor.

8. A warning device as claimed in claim 7 wherein said platinum sensor comprises a Pt 100 sensor.

9. A warning device as claimed in claim 1 wherein said temperature sensor comprises a bimetallic strip.

10. A warning device as claimed in claim 1 further comprising recording means, connected to said temperature sensor, for storing a chronological progression of temperature sensed by said temperature sensor.

11. A warning device as claimed in claim 1 further comprising a power supply integrated with said housing connected at least to said signaling means.

12. A warning device as claimed in claim 1 wherein said means for removably attaching said warning device housing to an exterior of said housing of said x-ray generator comprises adhesive.

13. In an x-ray generator having a housing containing an x-ray tube and coolant surrounding said x-ray tube in said housing, the improvement of a warning device which identifies if said coolant reaches an excessive temperature, said warning device comprising:

a warning device housing;

a resistive temperature sensor in said warning device housing, said resistive temperature sensor having a resistance which changes dependent on temperature;

an alarm in said warning device housing which produces a perceptible warning upon being triggered;

an evaluation unit in said warning device housing, connected to said resistive temperature sensor and to said alarm, which evaluates a change in said resistance of said resistive temperature sensor and which triggers said alarm if said change in resistance exceeds a predetermined amount; and means for releasably attaching said warning device housing to an exterior of said housing of said x-ray generator with said resistive temperature sensor in radiative communication with said housing of said x-ray generator.

14. A warning device as claimed in claim 13 wherein said evaluation unit includes recording means, connected to said resistive temperature sensor, for storing a chronological progression of temperatures corresponding to chronological changes in said resistance.

15. A warning device as claimed in claim 13 further comprising a power supply contained in said warning device housing and connected to said alarm and to said evaluation unit.

* * * * *